United States Patent [19]

Schuss et al.

[11] Patent Number: 4,743,914

[45] Date of Patent: May 10, 1988

[54] SPACE FED ANTENNA SYSTEM WITH SQUINT ERROR CORRECTION

[75] Inventors: Jack J. Schuss, Sharon; Jerome D. Hanfling, Framingham, both of Mass.

[73] Assignee: Raytheon Company, Lexington, Mass.

[21] Appl. No.: 852,041

[22] Filed: Apr. 14, 1986

[51] Int. Cl.[4] ..... H01Q 3/46

[52] U.S. Cl. ..... 343/754; 343/753; 343/781 P; 343/781 CA

[58] Field of Search ..... 343/753, 754, 781 P, 343/781 CA

[56] References Cited

U.S. PATENT DOCUMENTS

| | | | |
|---|---|---|---|
| 3,305,867 | 2/1967 | Miccioli et al. | 343/754 |
| 3,979,754 | 9/1976 | Archer | 343/754 |
| 4,070,678 | 1/1978 | Smedes | 343/754 |
| 4,246,585 | 1/1981 | Maillous | 343/754 |
| 4,507,662 | 3/1985 | Rothenberg et al. | 343/754 |
| 4,544,927 | 10/1985 | Kurth et al. | 343/373 |
| 4,578,680 | 3/1986 | Haupt | 343/754 |
| 4,595,926 | 6/1986 | Kobus et al. | 343/754 |

OTHER PUBLICATIONS

Tang, R., "Survey of Time-Delay Beam Steering Techniques", in *Phased Array Antennas, Proceedings of the 1970 Symposium,* (1972: Artech House, Dedham, MA).

Fante, R. L., "Systems Study of Overlapped Subarrayed Scanning Antennas", in IEEE Transactions on Antennas and Propogation, vol. AP-28, No. 5, Sep. 1980.

Rotman, W. and Turner, R. F., "Wide-Angle Microwave Lens for Line Source Applications", IEEE Transactions on Antennas and Propagation, Nov. 1963.

"An Antenna for Limited Scan in One Plane: Design Criteria and Numerical Simulation" by G. V. Borgiotti, IEEE Transactions on Antennas and Propagation, vol. AP-25, No. 2, Mar. 1977, pp. 232-243.

"Subarraying Feeds for Low Sidelobe Scanned Arrays" by R. J. Mailloux, Electromagnetic Sciences Div/RADC, pp. 30-33.

"Transform Feed for Low Sidelobe Space-Fed Lens Phased Array Antenna" by J. D. Hanfling et al., Raytheon Co., Equipment Div., pp. 461-465.

"Space Feed Design for Solid State Phased Arrays", by J. D. Hanfling et al., International Symposium Digest, Antennas and Propagation, vol. 2, May 24-28, 1982, pp. 543-546.

"Array Antennas and Feed Networks for Phased Arrays", Radar Handbook, 1970 by McGraw-Hill, Inc.

*Primary Examiner*—William L. Sikes

*Assistant Examiner*—Doris J. Johnson

*Attorney, Agent, or Firm*—Christopher L. Maginniss; Richard Sharkansky

[57] ABSTRACT

A space fed antenna system is adapted to correct for beam pointing (squint) errors and collimation errors caused by frequency variations of the R.F. energy radiated by the antenna system. A subarray of radiating elements is spatially positioned between an electronic lens and the focal point of said lens. The subarray radiates R.F. energy with a spherical wavefront for illuminating the electronic lens, such spherical wavefront having a focal point coincident with the focal point of the electronic lens. A programmer is provided which controls the electronic lens to collimate and direct the R.F. energy from the subarray. A corporate feed is provided which couples to a plurality of phase shifters which feeds corresponding time delay units, which in turn feeds corresponding radiating elements in the subarray. The phase shifters, responsive to the programmer, provide the spherical wavefront to the R.F. energy radiated by radiating elements in the subarray. The time delay units, also responsive to the programmer, vary the phase of the R.F. energy radiated by said elements to correct the squint and collimation errors.

12 Claims, 1 Drawing Sheet

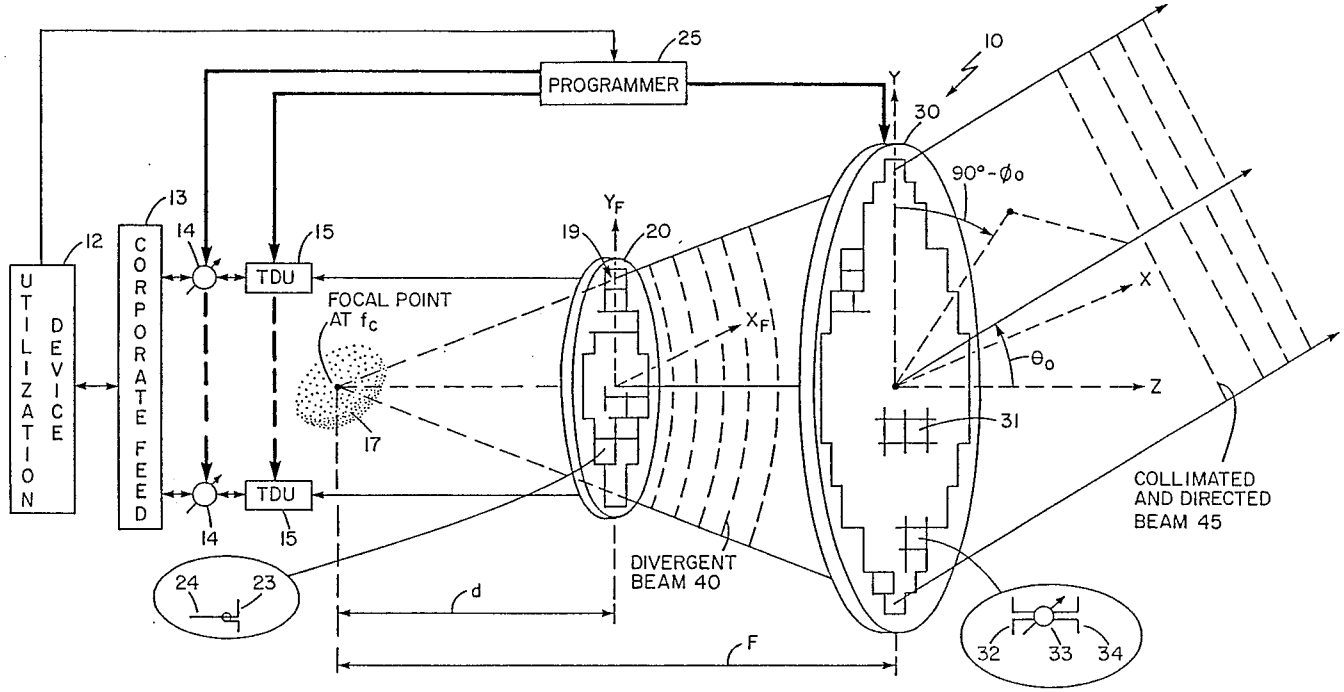
COLLIMATED AND DIRECTED BEAM 45
DIVERGENT BEAM 40
FOCAL POINT AT $f_c$
PROGRAMMER
TDU
TDU
CORPORATE FEED
UTILIZATION DEVICE
10
12
13
14
14
15
15
17
19
20
23
24
25
30
31
32
33
34
F
d
X
Z
Y
$X_F$
$Y_F$
$\theta_o$
$90°-\phi_o$

SPACE FED ANTENNA SYSTEM WITH SQUINT ERROR CORRECTION

This invention was made with Government support under Contract No. F-19628-83-C-014 awarded by the United States Air Force. The Government has certain rights in this invention.

BACKGROUND OF THE INVENTION

This invention relates to space fed antenna array systems, and more particularly, to wide band space fed antenna systems used in chirp or frequency hopping radars.

In space fed antenna systems, such as the antenna system shown in FIG. 1 of U.S. Pat. No. 3,305,867, issued to A. R. Miccioli and D. H. Archer on Feb. 21, 1967, entitled "Antenna Array System" and assigned to the assignee of this invention, radio frequency (R.F.) radiation to be collimated and directed is radiated by a transmitter horn which illuminates an electronic lens. The electronic lens is composed of a plurality of phase shifters responsive to a programmer. Different portions of the R.F. radiation from the transmitting horn are received by the plurality of phase shifters wherein predetermined corresponding phase shifts are imparted to the different portions of such R.F. radiation to radiate a beam of R.F. energy with a uniform phase front in a predetermined direction. However, the direction of the beam of R.F. energy radiated by the electronic lens is frequency dependent. For example, in a chirp or frequency hopping radar system employing an antenna system as described above, if a target is imaged in the far field with the beam of R.F. energy centered on that target at a predetermined frequency and that frequency is changed, the beam will squint off the target. The amount of squint error, $\Delta \sin \theta_0$, is given by the equation:

$$\Delta \mathrm{Sin}\ \theta_0 = \frac{\Delta f}{f} \sin \theta_0$$

wherein $\Delta f$ is the frequency difference of the radiated R.F. energy from the selected operating frequency f and $\theta_0$ is the scan angle of the radiated R.F. radiation off boresight of the antenna system. Should the frequency difference ($\Delta f$) be sufficiently large, the target could be lost completely. This squinting is a result of each of the phase shifters of the plurality of phase shifters in the electronic lens giving a constant phase shift, regardless of frequency, relative to other ones of the plurality of phase shifters. This squint error has the effect of moving the focal point parallel to the plane of the electronic lens for a fixed far field beam position. In addition, the effective focal length of the electronic lens varies with frequency, causing collimation errors. An obvious solution would be to physically move the feed horn (or the electronic lens) to reposition the focal point on the feed horn. This physical movement is slow and requires devices of considerable mechanical complexity, leading to an unwieldy, expensive and unreliable system. Another solution is to operate the radar over small frequency bands over which the squinting error is acceptable and resetting the phase shifters if another frequency band is used. However, if wide band operation is desired, as in a chirp radar, the number of such small frequency bands becomes large, thereby requiring a large number of resets of the phase shifters during a chirp interval. Further, if a large number of phase shifters is used in the electronic lens, e.g. ten thousand, a large amount of time would be spent resetting the phase shifters, thereby reducing the effectiveness of the radar. Additionally, the power handling capability of such antenna system is limited to the power handling capability of the transmitter horn.

SUMMARY OF THE INVENTION

It is therefore a primary object of this invention to provide a wide band space fed antenna system adapted to allow wide band chirp or frequency hopping radar operation with reduced squint error. It is a further object of this invention to provide a wide band antenna system adapted to reduce the squint error without changing the phase shifters in the electronic lens. It is still another object of this invention to provide a wide band, space fed, antenna system allowing very high power operation. These and other objects are obtained generally by placing a planar subarray having a plurality of radiating elements between a conventional electronic lens and the focal point of the lens. The plurality of radiating elements are fed by corresponding time delay units and phase shift units, which are in turn fed by a corporate feed. The phase shift units impart a spherical wavefront of R.F. radiation from the subarray to the electronic lens. The time delay units are adapted to provide a predetermined delay to compensate for squint error of the antenna system by having the focal point of the spherical wavefront coincide with the focal point of the electronic lens. By having the subarray located at a position other than the focus of the electronic lens, all of the plurality of radiating elements carry a proportionate share of the transmitted power allowing very high power operation of the antenna system.

BRIEF DESCRIPTION OF THE DRAWINGS

The foregoing features of this invention,, as well as the invention itself, may be more fully understood from the following detailed description of the drawing, in which:

The FIGURE is a simplified block diagram of an improved space fed antenna system according to the invention.

DESCRIPTION OF THE PREFERRED EMBODIMENT

The FIGURE is a simplified diagram of the improved antenna system 10 with the understanding that this diagram does not show the necessary support structure. It shall also be noted that the system 10 can be used for receiving as well as transmitting with a suitably adapted utilization device 12. The system 10 is adapted to operate over a band of frequencies centered about a frequency $f_c$. That band is divided into portions, each portion being the instantaneous bandwidth of the system 10 and having a corresponding center frequency $f0_i$. The instantaneous bandwidth is the bandwidth over which the system 10 can operate without adjusting any elements in the system, e.g. phase shifters. The utilization device 12 couples to corporate feed 13 which in turn couples to a plurality of conventional phase shifters 14, each having a predetermined phase shift, the phase shifts to be discussed in detail below. The corporate feed 13 is of conventional design as described in pages 11–52, 53 of the Radar Handbook, published by McGraw-Hill, Inc., in 1970, edited by M. I. Skolnik.

Briefly, corporate feed 13 couples R.F. energy from the utilization device 12 to each one of the plurality of conventional phase shifters 14 with substantially the same phase. R.F. energy from the plurality of phase shifters 14 feeds corresponding time delay units (TDU) 15 which, in turn, feed corresponding radiating elements 19 in subarray 20. Each TDU 15 imparts to R.F. energy passing to the radiating element 19 in the subarray 20 a corresponding amount of delay as selected by the programmer 25. Each TDU 15 is a tap delay line with tap spacing of $\lambda_c$, wherein $\lambda_c$ is the wavelength of an R.F. signal having the frequency $f_c$. Selection of the proper delay by the programmer 25 will be discussed in more detail below.

Referring in more detail to an exemplary radiating element 19, dipole element 23 couples to feed line 24 which in turn couples to the corresponding TDU 15. It should be noted that any suitable radiating element can be substituted for the dipole element 23.

Subarray 20 is parallel to and spatially separated from electronic lens 30, the lens 30 having a focal length F at frequency $f_c$. As noted above, the focal point of lens 30 is not fixed with varying frequency but moves within volume 17 as frequency of the R.F. energy is varied. Subarray 20 radiates R.F. energy illuminating one side of the electronic lens 30. This R.F. energy forms a divergent beam 40 having a spherical wavefront as that emitted by a point illumination source located at the focal point of the electronic lens 30. The subarray 20 is positioned a distance d from the focal point of the lens 30. The plurality of phase shifters 14, responsive to the programmer 25, provide the phase shift necessary to the R.F. energy radiated by the elements 19 in the subarray 20 to provide the spherical wavefront of the divergent beam 40. Each phase shifter 14 is of conventional design, such as ferrite or diode phase shifters. The amount of phase shift for each one of the phase shifters 14 to provide the spherical wavefront is determined by the equation:

$$\phi(X_F, Y_F) = \frac{-2\pi}{c} f0_i \sqrt{X_F^2 + Y_F^2 + d^2} + 2\pi N \frac{f0_i}{f_c}, \; i = l, \ldots, M$$

wherein c is the speed of light, $X_F$ and $Y_F$ are the Cartesian coordinates of each one of the elements 19 in the subarray 20, and d is the distance from the focal point to the subarray 20 and N is an integer, the value of which will be described below. The first term of the above equation provides the spherical wavefront to the divergent beam 40 to correct for coarse collimation errors due to a change in the instantaneous bandwidth center frequency $f0_i$. The second term is a TDU 15 correction factor to maintain the spherical wavefront to beam 40 when the center frequency $f0_i$ is not substantially equal to $f_c$ since each TDU 15 has a tap spacing $\lambda_c$. The electronic lens 30 is of conventional design, an example of which is disclosed in U.S. Pat. No. 3,305,867 as described above, and is composed of a plurality of cells 31. It should be noted that the arrangement of elements 19 of the subarray 20 is substantially similar to the arrangement of the cells 31 in the electronic lens 30, scaled by the ratio d/F.

Referring in more detail to an exemplary cell 31, dipole element 32 receives a portion of the R.F. energy radiated from the subarray 20 and couples same to phase shifter 33 which varies its electrical length in response to the programmer 25. Examples of devices that vary its electrical length are ferrite or diode phase shifters. Dipole element 34 radiates R.F. energy passing through phase shifter 33. It should be noted that an active type of phase shifter can be substituted for the phase shifter 33, such as an electronic transmit/receive (T/R) module providing gain and phase shift functions.

The utilization device 12 instructs programmer 25 what angle off boresight $\theta_0$ and azimuth $\phi_0$ the collimated and directed beam 45 is to be radiated at the frequency $f0_i$. The programmer 25 then sets the phase shifters 33 in lens 30 to provide a predetermined corresponding phase shift in each one of the phase shifters 33 to produce a directed and collimated wave 45 in the directions $\theta_0$ and $\phi_0$. This is well-known in the art and described in U.S. Pat. No. 3,305,867 as described above. To correct for the collimated and directed beam 45 squinting off a target (not shown) with a change in the frequency of the beam, programmer 25 sets TDUs 15 to provide a predetermined amount of delay. The electrical length, $L_{TDU}$, of each one of the TDUs 15 is given by:

$$L_{TDU}(X_F, Y_F) = \frac{1}{2} \frac{(X_F^2 + Y_F^2)}{d} \left( \frac{F - d}{d} \right) + \frac{F \sin\theta_0 (X_F \cos\phi_0 + Y_F \sin\phi_0)}{\sqrt{X_F^2 + Y_F^2 + d^2}}$$

The first term of the above equation corrects for fine collimation errors of the lens 30 due to the focal length F of the lens 30 varying with frequency over a selected one of the instantaneous bandwidths ($f0_i$ not changed). The second term corrects for movement of the focal point parallel to the plane of the lens 30 with frequency to steer the beam 45 back on target. The above corrections move the focal point of the divergent beam 40 to coincide with the deviated focal point of the lens 30. As described above, the TDU 15 is a tap delay line having a typical tap spacing of $\lambda_c$. Other values of tap spacing can be used as long as the TDU 15 correction factor is varied accordingly. The nearest multiple N of $\lambda_c$ for each TDU 15 is chosen to approximate $L_{TDU}$ from the above equation giving:

$$L_{TDU}(X_F, Y_F) = N\lambda_c$$

or $$N = \frac{L_{TDU}(X_F, Y_F)}{\lambda_c}$$

The programmer 25 calculates the required N for different $f0_i$ for each one of the TDUs 15 and sets the appropriate tap in each. In addition, programmer 25 adjusts the phase shifters 14 to provide the calculated corresponding phase shifters once $f0_i$ and N are known. Therefore, the phase shifters 14, 33 and TDUs 15 are adjusted by the programmer 25 only on a change of $\theta_0$, $\phi_0$ or $f0_i$.

Having described a preferred embodiment of this invention, it will now be apparent to one of skill in the art that other embodiments incorporating its concept may be used. It is felt, therefore, that this invention should not be limited to the disclosed embodiment, but rather should be limited only by the spirit and scope of the appended claims.

What is claimed is:

1. A space fed antenna system comprising:

lens means for collimating and directing R.F. energy into a planar wave in a predetermined direction;

radiating means, disposed between the lens means and the focal point of the lens means, for illuminating the lens means with R.F. energy having a diverging wavefront, the diverging wavefront having a focal point; and control means, coupled to the radiating means, for maintaining coincidence of the focal point of the diverging wavefront with the focal point of the lens means.

2. The space fed antenna system as recited in claim 1 further comprising:

programmer means for controlling the space fed antenna system; and wherein the lens means and control means are responsive to the programmer means.

3. In a space fed antenna system having an electronic lens with a focal point a distance F from the electronic lens, for collimating and directing a planar wave of R.F. energy in a predetermined direction, a feed apparatus for illuminating the electronic lens comprising:

means having a plurality of output ports for dividing R.F. energy from a source to the plurality of output ports;

a plurality of phase shifting means, each coupled to a corresponding one of the plurality of output ports, for providing corresponding predetermined phase shifts of the R.F. energy;

a plurality of time delay means, each coupled to a corresponding one of the plurality of phase shifting means, for providing predetermined corresponding time delays of the R.F. energy; and a plurality of radiating means, arranged in a plane about a centroid and coupled to corresponding ones of the plurality of time delay means, for illuminating the electronic lens with R.F. energy having a spherical wavefront, the spherical wavefront having a focal point;

wherein the predetermined time delays from the time delay means maintain the focal point of the spherical wavefront coincident with the focal point of the electronic lens.

4. The feed apparatus as recited in claim 3 further comprising a controller means for controlling the electronic lens to collimate and direct the planar wave of R.F. energy, wherein the plurality of time delay means and the plurality of phase shifting means are additionally responsive to the controller means.

5. The feed apparatus as recited in claim 4 wherein each one of the plurality of time delay means has a desired electrical length of $$(\tfrac{1}{2})[(X_F^2+Y_F^2)/d][(F-d)/d)]+[F\sin\theta_o(X_F\cos\phi_o+Y_F\sin\phi_o)]/\sqrt{X_F^2+Y_F^2+d^2}$$

where $\theta_0$ is the angle off boresight and $\phi_0$ is the azimuth of the predetermined direction of the planar wave of the R.F. energy from the electronic lens, $X_F$ and $Y_F$ are the Cartesian coordinates of the corresponding one of the plurality of radiating means and d is the distance of the centroid of the plurality of radiating means from the focal point to the electronic lens.

6. The feed apparatus as recited in claim 5 wherein each one of the plurality of time delay means is a tapped delay line having tap spacing of $\lambda_c$, where $\lambda_c$ is the wavelength of the center frequency $f_c$ of the operating bandwidth of the space fed antenna system, the tap being selected in response to the controller means to provide an electrical length, $N\lambda_c$, which length approximates the desired electrical length, for an integer value of N.

7. The feed apparatus as recited in claim 6 wherein each one of the plurality of phase shifting means provides a phase shift of $$\frac{-2\pi}{c} f0_i \sqrt{X_F^2 + Y_F^2 + d^2} + 2\pi N \frac{f0_i}{f_c}, \; i = l, \ldots, M$$

wherein c is the speed of light, and $f0_i$ is the center frequency of a selected portion of the operating bandwidth.

8. A space fed antenna array comprising:

corporate feed means;

a plurality of radiating means, each coupled to a corresponding output terminal of the corporate feed means, and responsive to radio frequency energy thereat for radiating a divergent radio frequency beam having a spherical wavefront, the divergent beam diverging as from a point of illumination;

lens means for receiving and collimating the divergent beam into a directed planar radio frequency beam; and a plurality of time delay means, each disposed between a corresponding one of the corporate feed means output terminals and a corresponding radiating means, for delaying radio frequency energy passing therebetween and for correcting squint errors of the directed planar beam which result from changes of the operating frequency of the radio frequency energy.

9. Apparatus as in claim 8 wherein at least one of the time delay means further comprises:

a tapped delay line having a plurality of settable taps with differential electrical lengths between taps of $\lambda_c$, where $\lambda_c$ is equal to the wavelength of the center operating frequency of the antenna array; and means responsive to the difference between the center operating frequency and the instantaneous frequency of the radio frequency energy for setting the appropriate tap.

10. A method for correcting squint errors caused as a space fed antenna array operates over a band of frequencies, the space fed antenna having a corporate feed that provides radio frequency energy at a plurality of output terminals, and further having an electronic lens for collimating and directing the energy, the method comprising the steps of:

phase shifting the energy at the plurality of output terminals to create a diverging radio frequency beam having a spherical wavefront, the spherical wavefront having a focal point; and time delaying the energy at the plurality of output terminals, to cause the electronic lens focal point to maintain coincidence with the spherical wavefront focal point.

11. A space fed antenna system comprising:

lens means, responsive to a planar wave of R.F. energy received from a predetermined direction, for directing the R.F. energy into a beam converging toward a focal point;

array element means, disposed between the lens means and the focal point of the lens means, for receiving the converging beam of R.F. energy; and control means, coupled to the array element means, for maintaining coincidence of the focal point of the converging beam with the focal point of the lens means.

12. The space fed antenna system as recited in claim 11 further comprising programmer means for controller the space fed antenna system, wherein the lens means and control means are responsive to the programmer means.

* * * * *